US006189434B1

(12) United States Patent
Kawaguchi et al.

(10) Patent No.: US 6,189,434 B1
(45) Date of Patent: Feb. 20, 2001

(54) SINGLE-HEADED PISTON TYPE SWASH-PLATE-OPERATED COMPRESSOR AND A METHOD OF PRODUCING A SWASH PLATE

(75) Inventors: Masahiro Kawaguchi; Shintaro Miura; Takuya Okuno; Hideki Mizutani; Kenji Takenaka; Manabu Sugiura; Hiroaki Kayukawa, all of Kariya (JP)

(73) Assignee: Kabushiki Kaisha Toyoda Jidoshokki Seisakusho, Kariya (JP)

( * ) Notice: Under 35 U.S.C. 154(b), the term of this patent shall be extended for 0 days.

(21) Appl. No.: 09/221,288

(22) Filed: Dec. 23, 1998

(30) Foreign Application Priority Data

Dec. 26, 1997 (JP) ..... 9-360155

(51) Int. Cl.[7] ..... F01B 3/00
(52) U.S. Cl. ..... 92/71; 92/155
(58) Field of Search ..... 92/71, 155

(56) References Cited

U.S. PATENT DOCUMENTS

| | | | | |
|---|---|---|---|---|
| 5,056,417 | | 10/1991 | Kato et al. | 92/71 |
| 5,630,355 | | 5/1997 | Ikeda et al. | 92/169.1 |
| 5,655,432 | * | 8/1997 | Wilkosz et al. | 92/71 |
| 5,875,702 | * | 3/1999 | Kawagoe et al. | 92/12.2 |
| 5,960,542 | * | 10/1999 | Umemura et al. | 29/888.02 |

FOREIGN PATENT DOCUMENTS

| | | | |
|---|---|---|---|
| 0 776 986 A1 | | 6/1997 | (EP) . |
| 60-22080 | | 2/1985 | (JP) . |
| 60-19972 | * | 2/1985 | (JP) . |
| 60022080 | | 2/1985 | (JP) . |
| 08199327 | | 8/1996 | (JP) . |
| 8-199327 | | 8/1996 | (JP) . |
| 09209926 | | 8/1997 | (JP) . |
| WO95/25224 | | 9/1995 | (WO) . |

OTHER PUBLICATIONS

EP 98 12 4481 Search Report dated Apr. 06, 2000.

* cited by examiner

*Primary Examiner*—Edward K. Look
*Assistant Examiner*—Thomas E. Lazo
(74) *Attorney, Agent, or Firm*—Woodcock Washburn Kurtz Mackiewicz & Norris LLP

(57) ABSTRACT

A single-headed piston type swash-plate-operated refrigerant compressor is provided with a swash plate mounted on a rotatable drive shaft and having front and rear opposite surfaces, single headed pistons arranged on the rear side of the swash plate to reciprocate in respective cylinder bores, and front and rear shoes to be held in slide-contact with the peripheral parts of the front and rear surfaces of the swash plate to engage a tail end part of each of the single headed pistons with the swash plate in which the front and rear surfaces of the swash plate are provided with respective uppermost layers having physical surface properties different from one another. A front uppermost and a rear uppermost layer of the swash plate are formed of a sprayed coating of, for example, a copper-base material and the rear uppermost layer is coated by a solid lubricant layer containing a solid lubricant, such as molybdenum disulfide, at least in a part of the solid lubricant. The thickness of the solid lubricant layer is measured and controlled by using the surface of the front layer as a reference plane.

17 Claims, 5 Drawing Sheets

SINGLE-HEADED PISTON TYPE SWASH-PLATE-OPERATED COMPRESSOR AND A METHOD OF PRODUCING A SWASH PLATE

BACKGROUND OF THE INVENTION

1. Field of the Invention

The present invention relates to a single-headed piston type refrigerant compressor of the type in which rotation of a swash plate is converted into a reciprocation of a plurality of single-headed pistons via a plurality of pairs of shoes arranged between an outer periphery of the swash plate and the single-headed pistons. The present invention also relates to a method of producing a swash plate suitable for being incorporated in the above-mentioned type of single-headed piston type refrigerant compressor.

2. Description of the Prior Art

A swash-plate-operated refrigerant compressor, either a double-headed piston type refrigerant compressor or a single-headed piston type refrigerant compressor, has a housing assembly including a cylinder block provided with a plurality of cylinder bores formed therein, a plurality of pistons respectively slidably fitted in the cylinder bores, a drive shaft supported by the housing assembly to be rotatable about an axis of rotation, and a swash plate fixedly mounted on the drive shaft within a crank chamber at a constant inclination with respect to a plane perpendicular to the axis of rotation of the drive shaft or mounted on the drive shaft so that its inclination can be adjustably changed in the crank chamber. A part of each piston, i.e., a substantially middle part if the piston is of a double-headed type or an end part opposite the compressing end surface if the piston is of a single-headed type, is connected to a peripheral part of the swash plate via a pair of shoes to provide an operative engagement between each piston and the swash plate. This operative engagement of each piston and the awash plate permits the conversion of rotating motion of the drive shaft and the swash plate into a reciprocating motion of each piston.

In this regard, it is an important technical problem to avoid seizure between the front and the rear surface of the swash plate and the pair of shoes as well as to reduce friction between contacting portions of the swash plate and the shoes to the least possible extent. A refrigerant gas entraining a lubricating oil mist is circulated through the swash plate compressor to lubricate movable components of the compressor. However, in an initial stage of operation of the compressor at a low temperature, the refrigerant gas washes off the lubricating oil remaining on the sliding surfaces of the swash plate before the lubricating oil mist reaches the swash plate and hence the surfaces of the swash plate are in a dried-surface condition having no lubricating oil, and therefore the swash plate and the shoes must unavoidably start to slide relative to each other without lubrication. Thus, the swash plate must be exposed to a very severe operating condition during the initial stage of sliding motion thereof. Moreover, a new refrigerant, such as R134a, which has recently become used instead of the conventional refrigerant for the protection of the ozonosphere is more effective in creating a dried-surface condition than the conventional refrigerant. Accordingly, demand for an improvement in the lubricating property of the surfaces of the swash plate has progressively increased.

Conventional methods intended to satisfy the above-mentioned demand by applying a surface treatment process to a swash plate have been proposed in Japanese Unexamined Patent Publication (Kokai) No. 60-22080 (Japanese Examined Patent Publication No. 5-10513), International Publication WO95/25224 and Japanese Unexamined Patent Publication (Kokai) No. 8-199327.

The typical conventional method disclosed in Japanese Unexamined Patent Publication (Kokai) No. 8-199327 includes forming of a sprayed metal coating of a copper-base or aluminum-base material on a swash plate made of a base metal, and forming of a plated coating of lead-base material or a film of a polytetrafluoroethylene over the sprayed metal coating. The plated film or the film of the polytetrafluoroethylene is formed over the surface of the sprayed metal coating in order to improve the antiseizing property of the sprayed metal coating and to prevent the sprayed metal coating from cracking.

Although the foregoing cited references disclose diverse techniques for the surface treatment of a swash plate, nothing is suggested in these techniques about means for securing compatibility between the surface treatment and management of thickness of the swash plate. For example, the afore-mentioned Japanese Unexamined Patent Publication (Kokai) No. 8-199327 discloses the technique of plating or coating the uppermost surface of a swash plate, but teaches nothing about the management of the thickness of the plated layer or the film in relation to an accurate management of the entire thickness of the swash plate.

Generally, in the swash-plate-operated refrigerant compressor, a special consideration is provided to determination of the amount of stroke of the pistons, in order to reduce a top clearance between each piston and a valve plate assembly when the piston is at its top dead center, i.e., the minimum volume of the cylinder bore during the compression stroke of the piston, to the smallest possible amount near zero. In view of the piston driving principle of the swash plate compressor, the determination of the amount of stroke of each piston largely depends on a production accuracy in the thickness of the swash plate with respect to a designed thickness. Therefore, if an appropriate surface treatment method is applied to the surface of the swash plate to reduce sliding friction between the surfaces of the awash plate and the shoes, a final object of improving the compression efficiency of the swash plate type compressor cannot be achieved if the surface treatment method makes it difficult to control the thickness of the swash plate.

SUMMARY OF THE INVENTION

Therefore, an object of the present invention is to provide a single-headed piston type swash-plate-operated refrigerant compressor in which sliding contact of a swash plate with shoes is improved so as to obtain a good antiseizing property, an enhanced abrasion resistance and a thickness accuracy, to thereby result in an achievement of a good compression efficiency.

Another object of the present invention is to provide a novel method of producing a swash plate for a single-headed piston type swash-plate-operated refrigerant compressor,-in which both an application of a surface treatment to a swash plate and easy controlling of a thickness of the swash plate can be concurrently achieved to eventually produce a swash plate having a high thickness accuracy.

In accordance with one aspect of the present invention, there is provided a single-headed piston type swash-plate-operated refrigerant compressor which comprises:

- a rotatably supported drive shaft having an axis of rotation thereof;
- a swash plate having an axially front and rear surfaces thereof, and mounted on the drive shaft for rotation together with the drive shaft;

at least one single-headed piston arranged on the rear side of the swash plate; and a pair of shoes arranged to keep in slide-contact with the front and rear surfaces of the swash plate to operatively engage an end part of the single headed piston with a peripheral part of the swash plate to thereby convert a rotating motion of the swash plate into a reciprocating motion of the single headed piston;

wherein the front and the rear surface of the swash plate are provided with respective uppermost layers thereof, having physical surface properties different from one another in a manner such that a slide-contact performance between the rear surface of the swash plate and the corresponding one of the pair of shoes is superior to that between the front surface of the swash plate and the corresponding other of the pair of shoes.

Preferably, the physical surface properties of the front and rear surfaces of the swash plate are made different by forming the uppermost layers of the front and rear surfaces of different materials.

Alternatively, the physical surface properties of the front and rear surfaces of the swash plate are made different by applying different surface treatment processes to the uppermost layers of the front and rear surfaces.

In the single-headed piston type swash-plate-operated refrigerant compressor, a suction reaction force resulting from application of a force to the piston to suck a refrigerant gas into an associated cylinder bore in which the piston is fitted acts mainly on the front surface of the swash plate through a front side shoe of the pair of shoes, and a compression reaction force resulting from application of a force on the piston to compress the refrigerant gas within the associated cylinder bore acts mainly on the rear surface of the swash plate through a rear side shoe of the pair of shoes. Both the suction reaction force and the compression reaction force could cause abrasion and seizing in a contacting area between the swash plate and the shoes. Practically, the compression reaction force is far greater than the suction reaction force. Therefore, it is necessary to improve the slide-contact performance of the rear surface of the swash plate more than the slide-contact performance of the front surface of the swash plate. When improving the slide-contact performance by forming the front and rear surfaces of the swash plate with appropriate material or by applying an appropriate surface treatment process to these surfaces, the improvement of the slide-contact performance of the rear surface of the swash plate should be made prior to that of the front surface of the swash plate. When improving the slide-contact performance of the rear surface of the swash plate, if it is tried to form a given layer capable of improving slide-contact performance in the rear surface, delicate control of production accuracy in, for example, determining the thickness of the layer is required.

In accordance with the present invention, during the production of a swash plate, formation of the uppermost layer of the front surface of the swash plate in conducted first by considering the fact that the slide-contact performance of the front surface of the swash plate may be inferior to that of the rear surface thereof and, subsequently, forming of the uppermost layer formed in the rear surface of the swash plate can be achieved while adjustably controlling the thickness of the uppermost layer of the rear surface by using the first-formed front surface as a reference plane. Thus, the controlling of the thickness of the uppermost layer formed in the rear surface of the swash plate and the thickness of the swash plate per se during the production thereof can be of very high quality.

If it is required to form the above-mentioned layers to improve the slide-contact performance on both the front and rear surfaces of the swash plate, both surfaces require a simultaneous control of layer thickness and accordingly, a reference plane must be formed in some part of the swash plate other than the front and the rear surfaces. In such a case, the measurement of the thickness of the formed layer or the swash plate might include an error and hence an accurate control of the thickness of the layer or the swash plate will be made difficult.

In a single-headed piston type swash-plate-operated variable capacity compressor in which an inclination of the swash plate can be controlled by supplying a high-pressure refrigerant gas from a discharge pressure region into a crank chamber formed in the compressor to receive therein the swash plate and by controlling an amount of extraction of the refrigerant gas from the crank chamber, the compressed refrigerant gas to be discharged into the discharge pressure region has a high pressure and a high temperature. Therefore, when the high-pressure refrigerant gas is supplied from the discharge pressure region into the crank chamber, the viscosity of a lubricating oil contained in the crank chamber tends to be reduced by the high-pressure and high-temperature refrigerant gas, and accordingly it is difficult to dissipate heat from the crank chamber. Accordingly, an undesirable condition that leads the surfaces of the swash plate to a dried condition might be formed in the crank chamber. Thus, the awash plate produced in accordance with the present invention is very effective for preventing an occurrence of seizing and abrasion in the contacting area between the swash plate and the shoes of the single-headed piston type swash-plate-operated variable compressor.

Preferably, a solid lubricant layer containing a solid lubricant at least in a part thereof is formed in the uppermost layer of the rear surface of the awash plate. The solid lubricant contained in the solid lubricant layer improves the slide-contact performance exhibited by the rear surface of the swash plate in slide-contact with the rear side shoe and improves the antiseizing property and abrasion resistance of the rear surface. The thickness of the solid lubricant layer can be measured and controlled by using the front surface of the swash plate as a reference plane.

The described single-headed piston type swash-plate-operated compressor may be provided with a piston which is made of an aluminum-base material, a pair of shoes which are made of an iron-base material, and a swash plate having the front surface thereof formed of a nonferrous material and the rear surface thereof coated by a solid lubricant layer containing a solid lubricant at least in part thereof. In this regard, since the piston and the shoes are made of different materials, respectively, seizing does not occur when the slide-contacting between the piston and the shoes is performed. Similarly, since the shoes and the rear surface of the swash plate are made of different materials, respectively, seizing does not occur during the slide-contacting between the shoes and the rear surface of the swash plate. Particularly, the solid lubricant contained in the solid lubricant layer formed on the rear surface of the swash plate improves the slide-contact performance exhibited by a contacting area between the shoes and the rear surface of the swash plate, and the antiseizing property and abrasion resistance of the swash plate. The thickness of the solid lubricant layer is measured and controlled by using the front surface of the swash plate as a reference plane.

The nonferrous material forming the front surface of the swash plate may be any one of copper-base materials, tin-base materials and aluminum-base materials including alumite.

In the described single-headed piston type swash-plate-operated compressor, the base material of the swash plate may be an iron-base material, and an intermediate layer of a copper-base or a tin-base material may be formed between a part of the iron-base material of the swash plate, and the solid lubricant layer formed on the rear surface of the swash plate. The intermediate layer of the copper-base cr the tin-base material can prevent the uppermost layer of the rear surface of the swash plate from being immediately exposed and from coming into direct contact with the shoes made of an iron-base material to cause seizing even it a part of the solid lubricant layer coating the uppermost layer of the rear surface of the swash plate is damaged by an unpredictable cause. Although not as effective as the solid lubricant layer, the intermediate layer is effective in improving slide-contact performance exhibited by a contact area between the shoes and the swash plate.

If the intermediate layer is a sprayed metal coating of a copper-base material, the solid lubricant layer coating the intermediate layer serves as a protective layer. If the sprayed metal coating of a copper-base material forms the boundary of the rear surface of the swash plate, local seizing and cracking are liable to occur in the sprayed metal coating due to the sliding contact of the shoe of-an iron-base material with the rear surface of the swash plate because the sprayed metal coating is hard and is difficult to be distorted according to external force exerted thereon. The solid lubricant layer formed over the sprayed metal coating of a copper-base material formed on the rear surface of the swash plate reduces frictional resistance of a contact part of the swash plate and stress induced in the sprayed metal coating, so that the sprayed metal coating is prevented from cracking.

In the described single-headed piston type swash-plate-operated compressor, the base material of the swash plate may be an aluminum-base material, and the intermediate layer of a tin-base material or alumite may be formed between a part of the aluminum-base material of the swash plate, and the solid lubricant layer formed on the rear surface of the swash plate.

The intermediate layer made of a tin-base material or alumite can prevent the aluminum-base material of the swash plate from being exposed and from coming into contact with the shoe and causing seizing when the solid lubricant layer formed on the rear surface of the swash plate is damaged by an unpredictable cause.

The intermediate layer of alumite is effective in enhancing the adhesion of the solid lubricant layer to the aluminum-base material of the swash plate.

The base material of the swash plate may be an aluminum-base material, and the solid lubricant layer may be formed on the rear surface of the base material of the swash plate. Preferably, the solid lubricant layer is formed on the rear surface of the aluminum-base material of the swash plate which surface is finished by a surface roughening process. The surface roughening process enhances the adhesion of the solid lubricant layer to the aluminum-base of the swash plate.

The above-described solid lubricant may be at least one of lubricating materials including molybdenum disulfide, tungsten disulfide, graphite, boron nitride, antimony oxide, lead oxide, lead, indium, tin and fluorocarbon resins. Those lubricating materials have proved effective in improving the slide-contact performance exhibited by a contacting area between the shoes and the swash plate.

In accordance with a further aspect of the present invention, there is provided a method of producing a swash plate, for a single-headed piston type swash-plate-operated refrigerant compressor in which a rotating motion of a swash plate mounted on a drive shaft rotatable about an axis of rotation extending from a front to a rear side of the compressor is converted through a pair of shoes into a reciprocating motion of a piston, which comprises:

A: a first step of forming a front surface in the swash plate so that the front surface is in direct contact with the first shoe of the pair of shoes and to serve as a reference plane;

B: a second step of forming a solid lubricant layer in a rear surface of the swash plate opposite to the front surface so that the solid lubricant layer is in direct contact with the second shoe of the pair of shoes and contains a solid lubricant at least in part thereof;

C: a third step of measuring at least one of the thickness of the solid lubricant layer formed on the rear surface or the thickness of the swash plate by using the front surface formed by the first step as the reference plane; and D: a fourth step of applying a grinding operation to the solid lubricant layer to adjust the thickness of the solid lubricant layer and that of the swash plate measured in the third step to desired thicknesses.

According to the described method, it is possible to measure the thickness of the solid lubricant layer formed on the rear surface of the swash plate and that of the swash plate by using the reference plane completed in the preceding step. Accordingly, the swash plate can be produced so that the solid lubricant layer of the swash plate and the swash plate per se can have respective thicknesses precisely coinciding with desired thickness values by grinding the solid lubricant layer.

BRIEF DESCRIPTION OF THE DRAWINGS

The above and other objects, features and advantages of the present invention will be made more apparent from the ensuing description of the preferred embodiments thereof, with reference to the accompanying drawings wherein.

DESCRIPTION OF THE PREFERRED EMBODIMENTS

Preferred embodiments of the present invention will be described hereinafter.

A single-headed piston type swash plate compressor embodying the present invention for an automotive air conditioning system will be described prior to the description of the construction of a swash plate, which is an essential part of the present invention, and a method of producing the swash plate.

Figure 1:
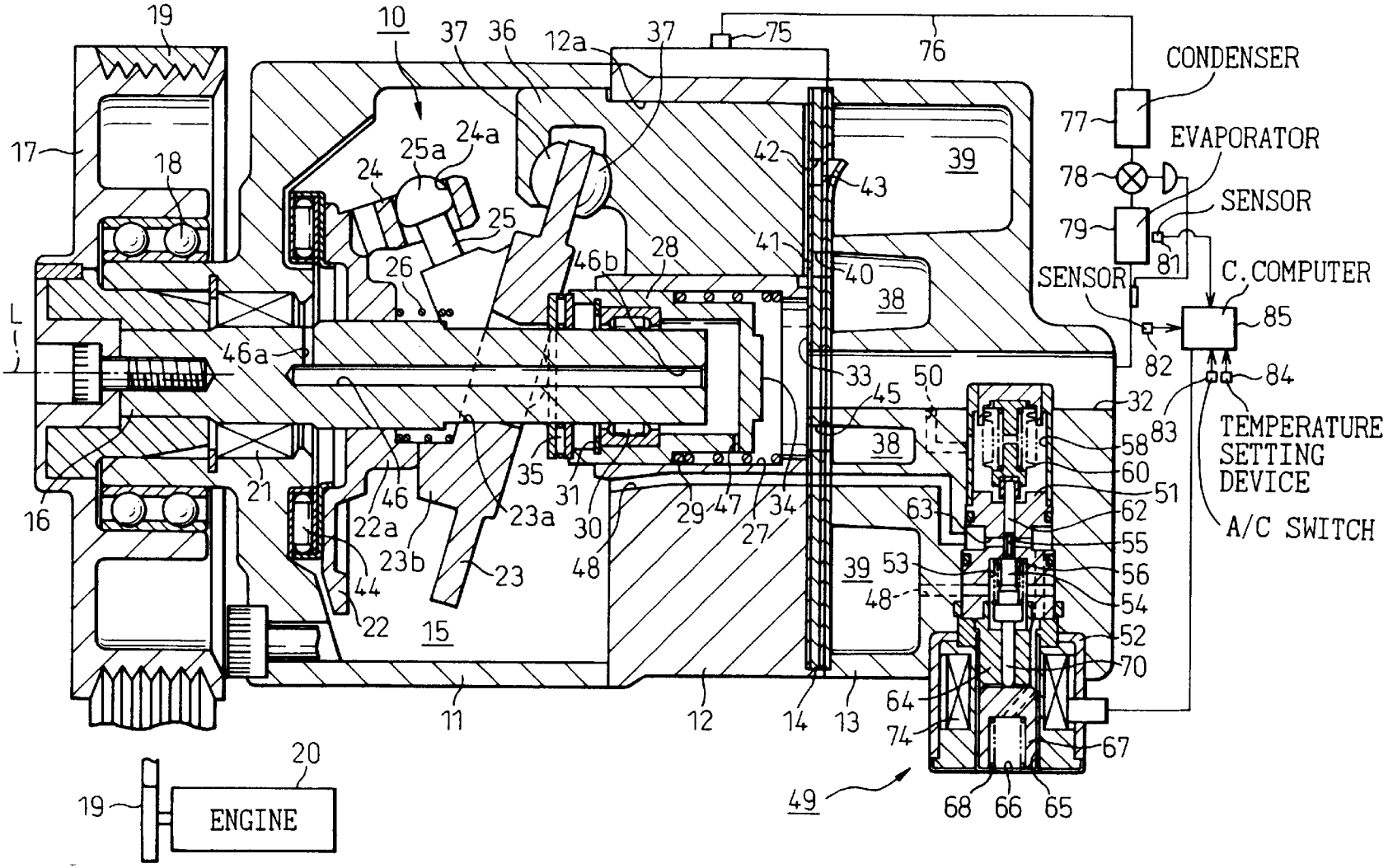
FIG. 1 is a longitudinal cross-sectional view of a single-headed piston type swash-plate-operated compressor to which the present invention is applied.

Basic Construction of Single-headed Piston Type Swash-Plate-Operated Refrigerant Compressor Referring to FIG. 1, a clutchless swash plate compressor has a cylinder block 12, a front housing 11 fixedly joined to the front end of the cylinder block 12, and a rear housing 13 fixedly joined to the rear end of the cylinder block 12 with a valve plate 14 sandwiched between the cylinder block 12 and the rear housing 13. The front housing 11 and the cylinder block 12 define a crank chamber 15. A drive shaft 16 is extended across the crank chamber 15 and is supported for rotation on the front housing 11 and the cylinder block 12. A pulley 17 is supported for rotation on an angular-contact bearing 18 mounted on a front end part of the front housing 11, and is fixed to a front end part of the drive shaft 16 projecting from the front housing 11. A belt 19 is wound around the pulley 17 to connect the pulley 17 operatively to an engine 20 of a vehicle, i.e., a drive-power source, without using any clutch mechanism, such as a solenoid clutch.

A lip seal 21 is fitted in a space between the outer circumference of the front end part of the drive shaft 16 and the front housing 11 to seal the front end of the crank chamber 15. A rotating support member 22 is fixedly mounted on the drive shaft 16 in the crank chamber 15. A swash plate 23, i.e., a cam plate, is arranged in the crank chamber 15. The drive shaft 16 is extended through a central through hole 23*a*, formed in the swash plate 23 to support the swash plate thereon, so that the swash plate 23 is able to slide axially along and to incline to the axis L1 of the drive shaft 16.

The rotating support member 22 and the swash plate 23 are interlocked by a hinge mechanism 10. The swash plate 23 is provided with a counterweight 23*b* on the opposite side of the hinge mechanism 10 with respect to the drive shaft 16. The hinge mechanism 10 comprises a pair of support arms 24 (only one of them is shown) projecting from the rear surface of the rotating support member 22, and a pair of guide pins 25 (only one of them is shown) projecting from the front surface of the swash plate 23. Each support arm 24 is provided in its end part with a guide hole 24*a*, and each guide pin 25 is provided in its end part with a spherical part 25*a*. The spherical parts 25*a* of the guide pins 25 are fitted in the guide holes 24*a* of the corresponding support arms 24, respectively.

The swash plate 23 can be inclined to the drive shaft 16 and can be rotated together with the drive shaft by the combined action of the support arms 24 and the guide pins 25. When the swash plate 23 is inclined, the guide holes 24*a* guide the spherical parts 25*a* for sliding movement, and the drive shaft 16 allows the swash plate 23 to slide thereon. The inclination of the swash plate 23 decreases as the swash plate 23 approaches the cylinder block 12. A coil spring 26 wound around the drive shaft 16 and arranged between the rotating support member 22 and the swash plate 23 biases the swash plate 23 toward the cylinder block 12 so as to assist the decrease of the inclination of the swash plate 23. A limiting projection 22*a* formed on the rear surface of the rotating support member 22 comes into contact with a part of the swash plate 23 as shown in FIG. 1 to determine a maximum inclination at which the swash plate 23 can be inclined.

The cylinder block 12 is provided in its central part with a cavity 27. A suction passage 32 is formed in a central part of the rear housing 13 so as to be connected to the cavity 27. A positioning surface 33 is formed around one end of the suction passage 32 on the side of the cavity 27. The cavity 27 and the suction passage 32 form part of a suction pressure region of the compressor.

A passage disconnecting piston 28 is fitted slidably in the cavity 27. A suction passage opening spring (coil spring) 29 is arranged between the passage disconnecting piston 28 and a shoulder formed in the cavity 27 to bias the passage disconnecting piston 28 toward the swash plate 23. A rear end part of the drive shaft 16 is inserted in the passage disconnecting piston 28 and is supported in a radial bearing 30 fitted in the passage disconnecting piston 28. The radial bearing 30 is retained in the passage disconnecting piston 28 by a snap ring 31 and is axially movable together with the drive shaft 16 along the axis L. The rear end part of the drive shaft 16 is supported in the radial bearing 30 for rotation on the passage disconnecting piston 28 fitted in the cavity 27. A closing surface 34 is formed on the rear end of the bottom wall of the passage disconnecting piston 28. The closing surface 34 comes into contact with and is separated from the positioning surface 33 as the passage disconnecting piston 28 moves axially. When the closing surface 34 is in contact with the positioning surface 33, the suction passage 32 is disconnected from a space in the cavity 27.

A thrust bearing 35 is supported slidably on the drive shaft 16 between the swash plate 23 and the passage disconnecting piston 28. The swash plate 23, the thrust bearing 35 and the passage disconnecting piston 28 are kept in contact with each other by the resilience of the coil spring 26 and the suction passage opening spring 29. Therefore, as the swash plate 23 slides toward the passage disconnecting piston 28 and the inclination of the swash plate 23 increases, the passage disconnecting piston 28 is forced to move toward the positioning surface 33 against the resilience of the suction passage opening spring 29 and, eventually, the closing surface 34 of the passage disconnecting piston 28 comes into contact with the positioning surface 33 to limit the further inclination of the swash plate 23. In this state, the swash plate 23 is inclined at a minimum inclination slightly greater than 0°.

The cylinder block 12 is provided with a plurality of cylinder bores 12*a* around the drive shaft 16, and single-headed pistons 36 are fitted for reciprocation in the cylinder bores 12*a*, respectively. A front end part of each piston 36 (an end part opposite the compression end surface) is linked by a pair of shoes 37 to a peripheral part of the swash plate 23. Thus, each piston is operatively connected to the swash plate 23 by the shoes 37 to convert a rotating motion of the swash plate 23 into a reciprocating motion of the piston 36 operatively connected to the swash plate 23 by the shoes 37.

When the inclination of the swash plate 23 changes, the stroke of the pistons 36 and the discharge capacity change accordingly. The top dead center of the piston 36 in the cylinder bore 12*a* remains substantially constant and only the lower dead center of the piston changes. Top clearance in the cylinder bore 12*a* when the piston 36 is at the top dead center is nearly equal to zero.

The rear housing 13 is provided with a substantially annular suction chamber 38, which forms a part of the suction pressure region, and a substantially annular discharge chamber 39, which forms a discharge pressure region, formed around the annular suction chamber 38. The suction chamber 38 communicates with the cavity 27 by means of a port 45 formed in the valve plate 14. When the closing surface 34 of the passage disconnecting piston 28 is brought into contact with the positioning surface 33, the port 45 is disconnected from the suction passage 32.

The valve plate 14 is provided with suction ports respectively opening into the cylinder bores 12*a*, suction valves 41 respectively for opening and closing the suction ports 40, discharge ports 42, and discharge valves 43 respectively for opening and closing the discharge ports 42. A refrigerant gas supplied from an external device into the suction chamber 38 is sucked through the suction port 40 and the suction valve 41 into the cylinder bore 12*a* by the suction stroke of each piston 36. The refrigerant gas taken into the cylinder bore 12*a* is discharged through the discharge port 42 and the discharge valve 43 by the compression stroke of the piston 36 into the discharge chamber 39. A compression reaction force that acts on the rotating support member 22 through the piston 36 when the piston 36 compresses the refrigerant gas is born by a thrust bearing 44 arranged between the rotating support member 22 and the inner surface of the front end wall of the front housing 11.

A passage 46 is formed in the drive shaft 16 along its axis. The passage 46 has a front end 46*a* opening into a region near the lip seal 21 in the crank chamber 15, and a rear end 46*b* opening into a space defined by the passage disconnecting piston 28. The passage disconnecting piston 28 is provided in its side wall with a pressure relief passage 47 opening into the cavity 27. The passage 46 and the pressure relief passage 47 form a bleed passage.

A supply passage 48 is formed through the cylinder block 12 and the rear housing 13 to connect the discharge chamber 39 and the crank chamber 15. A capacity control valve 49 is placed in the supply passage 48. A pressure sensing passage 50 is formed in the rear housing 13 so as to connect the capacity control valve 49 and the suction passage 32.

Figure 2:
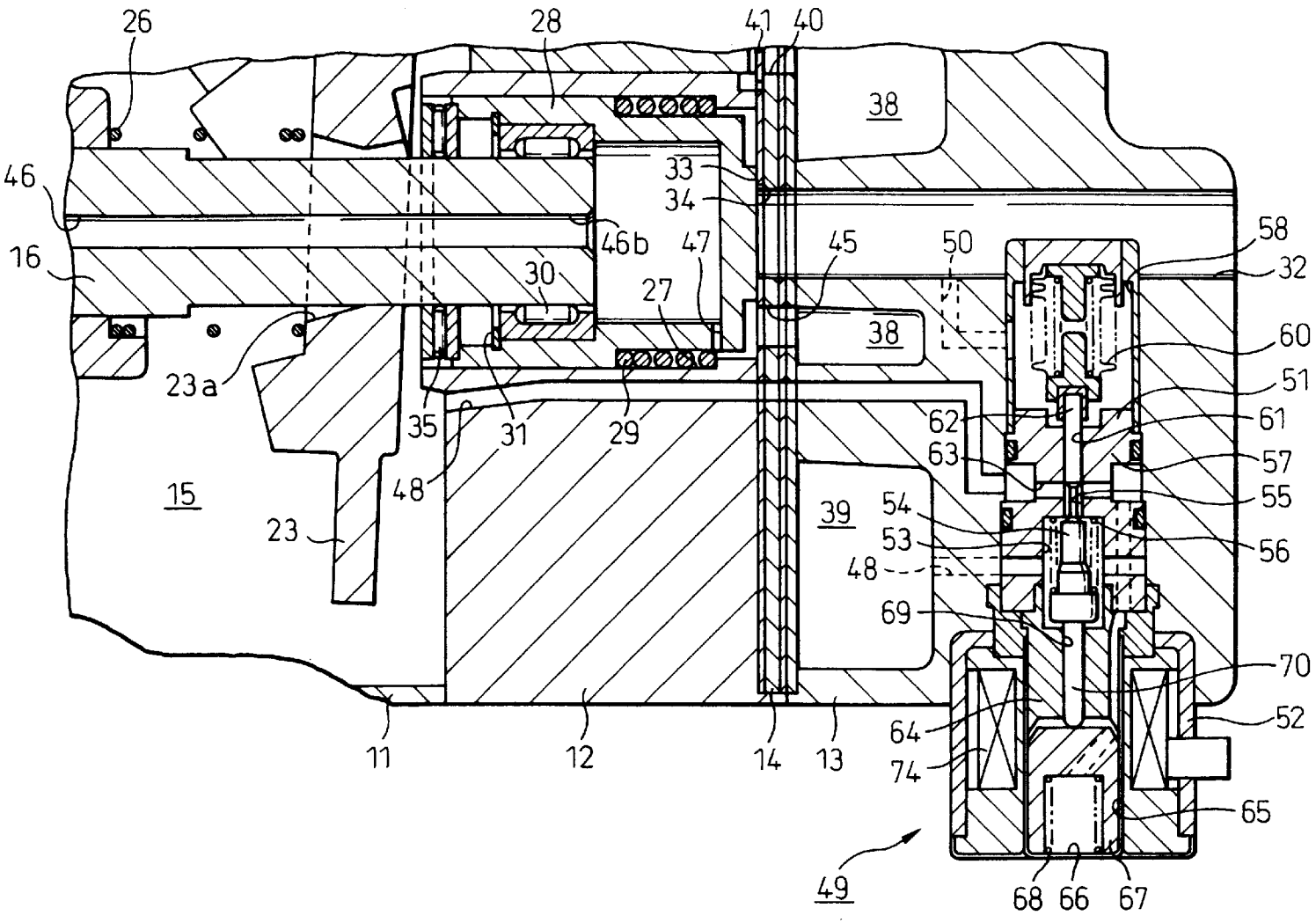
FIG. 2 is an enlarged fragmentary sectional view of the compressor in a state for operation at a minimum discharge capacity.

Referring to FIG. 2, a valve housing 51 and a solenoid unit 52 are joined together in a middle part of the capacity control valve 49. A valve chamber 53 is formed between the valve housing and the solenoid unit 52. A valve element 54 is placed in the valve chamber 53. A valve hole is extended along the axis of the valve housing 51 and opposite to the valve element 54. A valve opening spring 56 is placed between the valve element 54 and a wall defining the valve chamber 53 to bias the valve element 54 in a direction to open the valve hole 55. The valve chamber 53 communicates with the discharge chamber 39 by means of the supply passage 48.

A pressure sensing chamber 58 is formed in an upper part of the valve housing 51 and is connected to the pressure sensing passage 50, A bellows 60, i.e., a pressure sensing device, is contained in the pressure sensing chamber 58. The pressure sensing chamber 58 and the valve chamber 53 are separated from each other by a partition wall 57 of the valve housing 51, and a through hole 61 is formed in the partition wall 57 to connect the chambers 58 and 53. A section of the through hole 61 on the side of the valve element 54 serves as the valve hole 55. A pressure sensing rod 62 is slidably fitted in the through hole 61. The valve element 54 and the bellows 60 are operatively connected by the pressure sensing rod 62. A section of the pressure sensing rod 62 on the side of the valve element 54 is reduced to form a passage for the refrigerant gas in the valve hole 55.

A port 63 is formed in the valve housing 51 in a part between the valve chamber 53 and the pressure sensing chamber 58 so as to intersect the valve hole 55 perpendicularly. The port 63 communicates with the crank chamber 15 by means of the supply passage 48; that is, the valve chamber 53, the valve hole 55 and the port 63 are parts of the supply passage 48. A stationary core 64 is fitted in an upper part of a core chamber 65 formed in the solenoid unit 52 to define a solenoid chamber 66. A movable core 67 having the shape of a bottomed cylinder is fitted axially movably in the solenoid chamber 66. A spring 68 is arranged between the movable core 67 and the bottom wall of the core chamber 65. The spring constant of the spring 68 is smaller than that of the valve opening spring 56.

The stationary core 64 is provided with an axial through hole 69 opening into the solenoid chamber and the valve chamber 53. A solenoid rod 70 formed integrally with the valve element 54 is fitted slidably in the through hole 69. One end of the solenoid rod 70 on the side of the movable core 67 is held in contact with the movable core 67 by the biasing forces of the valve opening spring 56 and the spring 68. The movable core 67 and the valve element 54 are connected operatively by the solenoid rod 70. A cylindrical solenoid 74 is arranged around the stationary core 64 and the movable core 67 so as to extend over both the cores 64 and 67.

As shown in FIG. 1, the swash plate compressor is connected to an external refrigerant circuit 76 by the suction passage 32 through which the refrigerant gas is taken into the suction chamber 38, and a discharge flange 75 through which the refrigerant gas is discharged from the discharge chamber 39. The external refrigerant circuit 76 is provided with a condenser 77, an expansion valve 78 and an evaporator 79. The awash plate compressor, the condenser 77, the expansion valve 78 and the evaporator 79 are the components of the automotive air conditioning system.

An evaporator temperature sensor 81, a passenger compartment temperature sensor 82, an air conditioning system operating switch 83, a passenger compartment temperature setting device 84 and the solenoid 74 of the capacity control valve 49 are connected to a control computer 85. The control computer 85 controls the current to be supplied to the solenoid 74 on the basis of measured temperatures measured by the temperature sensors 81 and 82, a signal indicating the condition of the air conditioning system operating switch 83, and a set temperature signal indicating a set temperature set by operating the passenger compartment temperature setting device 84.

The description of the operation of the swash-plate-operated refrigerant compressor will be provided below.

When the air conditioning system operating switch 83 is in an on-state and a passenger compartment temperature measured by the passenger compartment temperature sensor 81 is not lower than a set temperature, the control computer 85 gives a command to energize the solenoid 74. Then a predetermined current is supplied to the solenoid 74, and an attraction of a magnitude proportional to the current supplied to the solenoid 74 acts between the cores 64 and 67. The attraction is transmitted through the solenoid rod 70 to the valve element 54 and acts in a direction to reduce the opening of the capacity control valve 49 against the resilience of the valve opening spring 56. A movable end of the bellows 60 is displaced according to the variation of the suction pressure prevailing in the suction passage 32 and acting through the pressure sensing passage 50 on the pressure sensing chamber 58. The bellows 60 responds to the suction pressure when the solenoid 74 is energized. The displacement of the movable end of the bellows is transmitted through the pressure sensing rod 62 to the valve element 54. The opening of the capacity control valve 49 is dependent on the balance of the force produced by the solenoid unit 52, the force produced by the bellows 60 and the force produced by the valve opening spring 56.

For example, the difference between the passenger compartment temperature measured by the passenger compartment temperature sensor 82 and the set temperature set by the passenger compartment temperature setting device 84 is large when cooling load is high. The control computer 85 controls the current to be supplied to the solenoid 74 to vary the set-suction pressure on the basis of the measured passenger compartment temperature and the set passenger compartment temperature; that is, the control computer 85 increases the current according to the increase of the difference between the measured passenger compartment temperature and the set passenger compartment temperature. Consequently, the attraction acting between the stationary core 64 and the movable core 67 increases to increase the force acting on the valve element 54 to reduce the opening of the capacity control valve 49, and the valve element 54 is operated for an opening and closing operation at a lower suction pressure. Thus, the capacity control valve 49 operates to hold the suction pressure on a lower level when the current supplied to the solenoid 74 is increased.

When the valve element 54 is shifted in a direction to reduce the opening of the capacity control valve 49, the flow rate of the refrigerant gas flowing from the discharge chamber 39 through the suction passage 48 into the crank chamber 15 is reduced. On the other hand, the refrigerant gas flows from the crank chamber 15 through the passage 46 and the pressure relief passage 47 into the suction chamber 38 and the pressure in the crank chamber 15 drops. When the cooling load is high, the suction pressure in the cylinder bores 12*a* is high, and the difference between the pressure in the crank chamber 15 and the suction pressure in the cylinder bores 12*a* decreases, whereby the inclination of the swash plate 23 tends to increase.

In a state where the effective sectional area of the supply passage 48 is zero, i.e., a state where the valve hole 55 is closed completely by the valve element 54 of the capacity control valve 49, the supply of the high-pressure refrigerant gas from the discharge chamber 39 into the crank chamber 15 is stopped. Then, the pressure in the crank chamber 15 approaches the pressure in the suction chamber 38 and the swash plate 23 is inclined at its maximum inclination.

When the cooling load is low, the difference between the passenger compartment temperature and the set temperature is small. The control computer 85 gives a command to supply lower currents for lower passenger chamber temperature. Therefore, the attraction acting between the stationary core 64 and the movable core 67 is low and the force acting on the valve element 54 in a direction to reduce the opening of the capacity control valve 49 is reduced. The valve element 45 is operated for opening and closing by a higher suction pressure. Thus, the capacity control valve 49 operates to hold the suction pressure on a higher level when the current supplied to the solenoid 74 is reduced.

When the valve element 54 is operated so as to increase the opening of the capacity control valve 49, the flow rate of the refrigerant gas flowing from the discharge chamber 39 into the crank chamber 15 increases to raise the pressure in the crank chamber 15. In a state where the cooling load is low, the suction pressure in the cylinder bores 12*a* is low and the difference between the pressure in the crank chamber 15 and the suction pressure in the cylinder bores 12 increases and, consequently, the inclination of the awash plate 23 tends to decrease.

As the cooling load approaches zero, the temperature of the evaporator 79 approaches a frosting temperature at which frost starts to accumulate on the evaporator 79. The frosting temperature reflects a condition in which frost is likely to accumulate on the evaporator 79. Upon the drop of the temperature ot the evaporator 79 below the frosting temperature, the control computer 85 provides a command to de-energize the solenoid 74. The control computer 85 provides a command to de-energize the solenoid 74 also when the air conditioning system control switch 83 is opened.

Supply of the electric current to the solenoid 74 is stopped to de-energize the solenoid 74 and the magnetic attraction acting between the stationary core 64 and the movable core 67 disappears. Consequently, the valve element 54 is shifted down by the resilience of the valve opening spring 56 against the resilience of the spring 68 acting thereon through the movable core 67 and the solenoid 74 to fully open the valve hole 55. Thus, the high-pressure refrigerant gas flows at a high flow rate from the discharge chamber 39 through the supply passage 48 into the crank chamber 15 and the pressure in the crank chamber 15 rises. Consequently, the inclination of the swash plate 23 is reduced to the minimum angle of inclination.

The operation of the capacity control valve 49 varies according to the intensity of the electric current supplied to the solenoid 74. The capacity control valve 49 is operated at a low suction pressure when the electric current is large and is operated at a high suction pressure when the electric current is small. The compressor changes the angle of inclination of the swash plate 23 and its discharge capacity to maintain the suction pressure at the set suction pressure. Namely, the capacity control valve 49 operates for both changing the set suction pressure by changing the input current and making the compressor operate at its minimum capacity regardless of the suction pressure. The compressor provided with the capacity control valve 49 changes the refrigerating capacity of a refrigeration circuit.

When the swash plate 19 is set at the minimum inclination, the closing surface 34 of the passage disconnecting piston 28 comes into contact with the positioning surface 33 to disconnect the suction passage 32 from the cavity 27. In this state, the effective sectional area of the suction passage 32 is zero and the flow of the refrigerant gas from the external refrigerant circuit 76 into the suction chamber 38 is intercepted. The minimum angle of inclination of the swash plate 23 is slightly greater than 0°. The swash plate 23 is inclined at the minimum inclination when the passage disconnecting piston 28 is located at a disconnecting position where the passage disconnecting piston 28 disconnects the suction passage 32 from the cavity 27. The position of the passage disconnecting piston 28 varies between the disconnecting position and a connecting position to connect the suction passage 32 and the cavity 27 according to the variation of the inclination of the swash plate 23.

Since the minimum angle of inclination of the swash plate 23 is not equal to 0°, the refrigerant gas is discharged from the cylinder bores 12*a* into the discharge chamber 39 while the compressor is operating with the swash plate 23 inclined at the minimum inclination. The refrigerant gas discharged from the cylinder bores 12*a* into the discharge chamber 39 flows through the supply passage 48 into the crank chamber 15 and flows further through the passage 46 and the pressure relief passage 47 into the suction chamber 38. Then the refrigerant gas is taken from the suction chamber 38 into the cylinder bores 12*a* and then discharged again into the discharge chamber 39. Thus, a circulation circuit passing the discharge chamber 39, i.e., the discharge pressure region, the supply passage 48, the crank chamber 15, the passage 46, the pressure relief passage 47, the cavity 27, the suction chamber 38, i.e., the suction pressure region, and the cylinder bores 12*a* is formed in the compressor when the swash plate 23 is inclined at the minimum inclination. In this state, there is pressure difference between the discharge chamber 39, and the crank chamber 15 and the suction chamber 38. Therefore, lubricating oil entailed by the refrigerant gas can be supplied to the sliding surfaces of the components of the compressor as the refrigerant, gas circulates through the circulating circuit.

Construction of the Swash Plate

The surface construction of the swash plate, which is an important feature of the present invention, will be described with reference to FIGS. 3 through 5.

Figure 3:
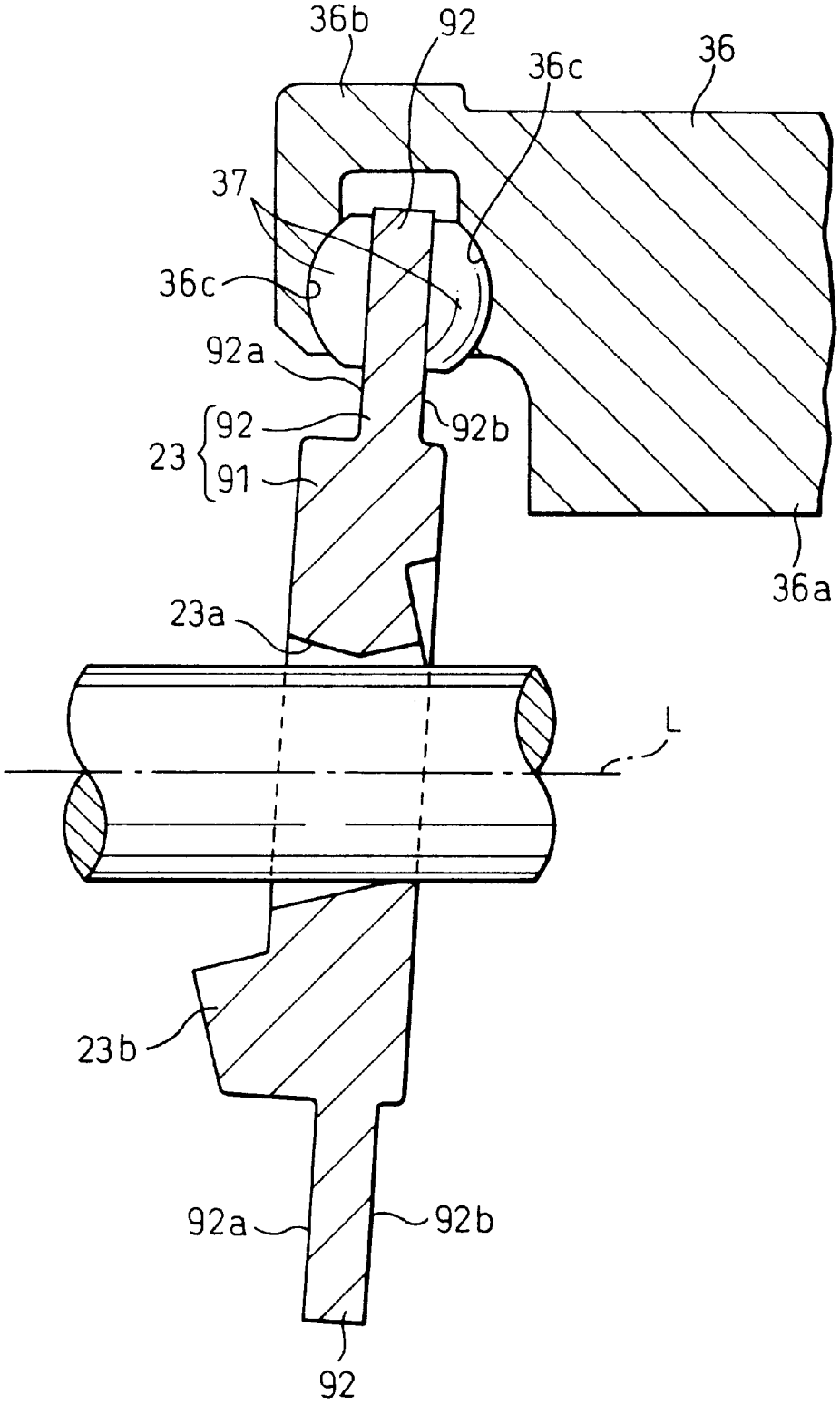
FIG. 3 is a schematic sectional view illustrating a relation between a drive shaft, a swash plate and a single-headed piston.

Referring to FIG. 3, the swash plate 23 has a central land part 91 and a peripheral part 92 surrounding the land part 91 and having the shape of a flange. The thickness of the land part 91 is greater than that of the peripheral part 92. The land part 91 is provided with the central through hole 23*a* and the counterweight 23*b*. The peripheral part 92 of the swash plate 23 has a front surface 92*a* facing the rotating support member 22 arranged in the crank chamber 15, and a rear surface 92*b* facing the head parts 36*a* of the single-headed pistons 36. As shown in FIGS. 3 and 4, the tail end part 36*b* of each single-headed piston 36 opposite the head part 36*a* of the same is provided with a pair of spherical surfaces 36*c* for guiding the pair of shoes 37 for sliding movement along a guide circle indicate by long and short dash lines in FIG. 4. The shoes 37 are held between the pair of spherical surfaces 36*c* and the peripheral part 92 of the swash plate 23 inserted in the space between the spherical surfaces 36*c*. Thus, the shoes 37 are held for turning on the tail end part 36*b* of the single-headed piston 36, and the tail end part 36*b* is linked to the peripheral part 92 of the swash plate 23 by the shoes 37.

Figure 4:
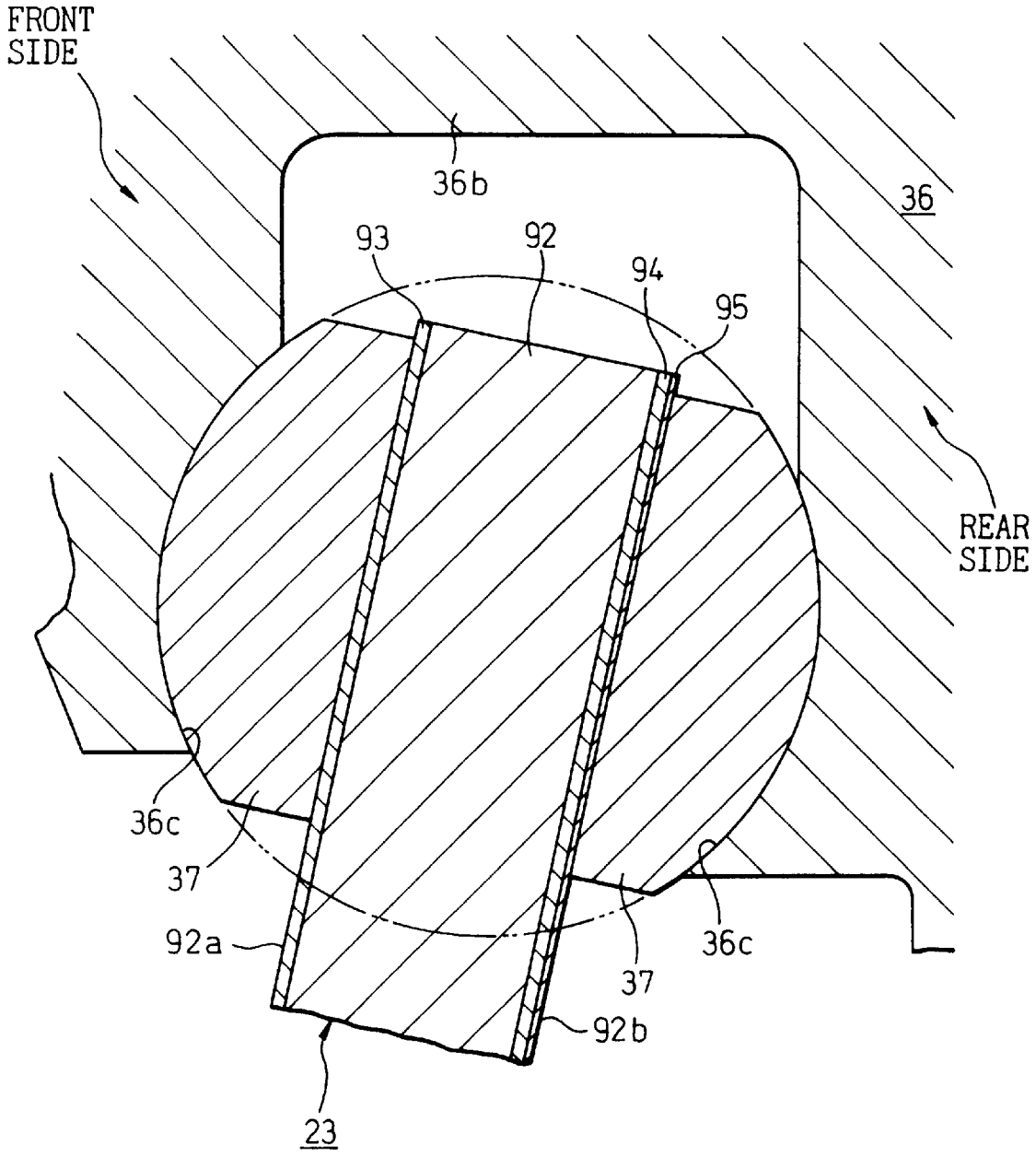
FIG. 4 is an enlarged sectional view illustrating a relation between the swash plate and the shoes.

FIG. 4 illustrates surface layers formed on the opposite surfaces 92*a* and 92*b* of the peripheral part 92 of the swash plate 23. A front layer 93 is formed on the front surface of the peripheral part 92, a first rear layer 94 is formed on the rear surface of the peripheral part 92, and a second rear layer 95 is formed on the first rear layer 94. The front layer 93 is the outermost surface layer on the front side of the swash plate 23. The second rear layer 95 is the outermost surface layer on the rear side of the swash plate 23, and the first rear layer 94 is an intermediate layer sandwiched between the outermost layer and the peripheral part of the swash plate 23. In this specification, a part of the swash plate 23 excluding the front layer 93, the first rear layer 94 and the second rear layer 95, i.e., a part consisting of the land part 91 and the peripheral part 92, will be called a 'body'.

The body of the swash plate 23 is made of an iron-base or an aluminum-base material. Each of the single-headed pistons 36 is made of an aluminum-base material in a light-weight member. The shoes 37 are made of an iron-base material, such as a bearing steel. In this specification, the term, 'iron-base material' indicates pure iron or an alloy containing iron as a principal component, and the term, 'aluminum-base material' indicates pure aluminum, an alloy containing aluminum as a principal component or an intermetallic compound containing aluminum. Aluminum alloys suitable for forming the body of the swash plate are Al—Si alloys, Al—Si—Mg alloys, Al—Si—Cu—Mg alloys and aluminum alloys not containing Si.

Front Layer and First Rear Layer

The front layer 93 and the first rear layer 94 are formed of the same material. The front layer 93 and the first rear layer 94 are copper-base alloy layers, tin-base base alloy layers or alumite layers (layers formed by the anodic oxidation of aluminum), depending on the material of the body (91, 92). Preferably, the respective thicknesses of the front layer 93 and the first rear layer 94 are in the range of 2 to 500 micrometers ($\mu$m). Preferably, the copper-base alloy layers are formed by a metal spraying process. The metal spraying process may be conducted by either a method of forming a layer in which a molten metal produced by entirely melting a metal powder to be sprayed is solidified or a method of partly melting a metal powder to be sprayed without changing the structure of the metal powder. Although pure copper (Cu) may be used for the metal spraying process, it is preferable to use a Cu—Sn alloy containing Cu and 2 through 15% by weight tin (Sn), which serves as a strengthening element. The Cu-base alloy may contain 2 through 30% by weight lead (Pb), which provides conformability and a low frictional property. The Cu-base alloy may further contain 0.1% by weight or less phosphorus (P) and 5% by weight of less silver (Ag). A copper spraying process applicable to the present invention is described in detail in International Publication WO95/25224.

The tin-base alloy layers of a tin-base alloy can be formed by a similar metal spraying process. A pure tin may be used instead of the tin-base alloy.

The alumite layers can be formed by subjecting the body of an aluminum-base material to a standard anodizing process. Preferably, the thickness of the alumite layer, i.e., an anodic coating, is in the range of 2 through 20 micrometers ($\mu$m). Generally, the anodic coating is dense, hard and has high abrasion resistance and excellent adhesion to a base of an aluminum alloy.

Second Rear Layer

The second rear layer 95, i.e., an outermost rear layer, is a solid lubricant layer containing a solid lubricant at least in a part thereof. Preferably, the thickness of the solid lubricant layer is in the range of 0.5 through 50 $\mu$m, more preferably, in the range of 0.5 through 10 $\mu$m.

Concretely, the solid lubricant layer is a layer of an inorganic or an organic solid lubricant or a resin layer containing an inorganic or an organic solid lubricant. Possible inorganic solid lubricants are molybdenum disulfide, tungsten disulfide, graphite, boron nitride, antimony oxide, lead oxide, lead (Pb), indium (In) and tin (Sn). Possible organic solid lubricants are fluorocarbon resins, such as polytetrafluoroethylene resins (PTFE resins), and unsaturated polyester resins.

Swash plates each provided with a front layer 93, a first rear layer 94 and a second rear layer 95 in Examples 1 to 7 and prior art swash plates in Comparative examples 1 and 2 will be described hereinafter.

EXAMPLE 1

A copper-base alloy containing 5 through 10% by weight Sn and 1 through 10% by weight Pb was sprayed at a powder feed rate of 50 gram/min with a spraying gun (Diamond jet gun available from the manufacturing company in Japan, named "Daiichi Metakon") over the opposite surfaces of the body of an iron-base material of a swash plate. The front and the rear surface of the peripheral part 92 of the body were ground, after the sprayed copper-base alloy coatings cooled off, to form a front layer 93 and a first rear layer 94 of about 150 $\mu$m in thickness. The surfaces of the front layer 93 and the first rear layer 94 were cleaned and degreased, and then the surface of the first rear layer 94 was coated with a coating layer of a material prepared by dispersing molybdenum disulfide particles of particle sizes in the range of 0.5 through 20 $\mu$m in a polyamidimide resin by a spray coating process. The coating layer was baked at 200° C. The rear surface 92*b* of the peripheral part of the swash plate was ground to form a 10 μm thick second rear layer 95.

The swash plate thus fabricated was incorporated into the foregoing single-headed piston type swash plate compressor and the single-headed piston type swash plate compressor was operated for the operational suitability test of the swash plate. During the operational suitability test, a lubricating oil was supplied at a rate equal to about 10% of a rate at which the lubricating oil is supplied for the practical operation of the single-headed piston type swash plate compressor, and the drive shaft 16 was rotated at about 3,000 rpm for fifteen minutes. The front and the rear surface of the swash plate was observed to examine the front and rear surfaces for cracking and seizing after the operational suitability test. No defect was found.

EXAMPLE 2

A tin-base alloy was sprayed at a powder feed rate of 50 gram/min with the same spraying gun over the opposite surfaces of the body of an iron-base material of a swash plate. The front and the rear surface of the peripheral part 92 where ground, after the sprayed tin-base alloy coatings cooled off, to form a front layer 93 and a first rear layer 94 of about 150 μm in thickness. Subsequently, the surfaces of the front layer 93 and the first rear layer 94 were cleaned and degreased, and then the surface of the first rear layer 94 was coated with a coating layer of a material prepared by dispersing molybdenum disulfide particles of particle sizes in the range of 0.5 to 20 μm in a polyamidimide resin by a spray coating process. The coating layer was baked at 200° C. The rear surface 92*b* of the swash plate was ground to form a 10 μm thick second rear layer 95.

The swash plate thus produced was incorporated into the foregoing single-headed piston type swash plate compressor and the single-headed piston type swash plate compressor was operated for the same operational suitability test of the swash plate. No defects, such as cracks and abrasively damaged parts in the layers, were found.

EXAMPLE 3

Tin-base alloy coatings were formed by plating on the opposite surfaces of the body of an aluminum-base material of a swash plate. The front and the rear surface of the peripheral part 92 were ground to form a front layer 93 and at first rear layer 94 of about 150 μm in thickness. The surfaces of the front layer 93 and the first rear layer 94 were cleaned and degreased, and then the surface of the first rear layer 94 was coated with a coating layer of a material prepared by dispersing molybdenum disulfide particles of particle sizes in the range of 0.5 through 20 μm in a polyamidimide resin by a spray coating process. The coating layer was baked at 200° C. The rear surface 92*b* of the peripheral part of the swash plate was ground to form a 10 μm thick second rear layer 95.

The swash plate thus produced was incorporated into the foregoing single-headed piston type swash plate compressor and the single-headed piston type swash plate compressor was operated for the same operational suitability test of the swash plate. No defects, such as cracks and abrasively damaged parts, were found.

EXAMPLE 4

The body of an aluminum-base material of a swash plate was immersed in a sulfuric acid solution or an oxalic acid solution and was subjected to an anodizing process to form an oxide film (alumite layer) over the surface of the body made of the aluminum-base material. The body of the swash plate was washed with water. The respective measured thicknesses of the alumite layers forming the front layer 93 and the rear layer 94 were about 15 μm. The surfaces of the alumite layers were cleaned and degreased, and then the surface of the first rear layer 94 was coated with a coating layer of a material prepared by dispersing molybdenum disulfide particles of particle sizes in the range of 0.5 through 20 μm in a polyamidimide resin by a spray coating process. The coating layer was baked at 200° C. The rear surface 92*b* of the peripheral part of the swash plate was ground to form a 10 μm thick second rear layer 95.

The swash plate thus fabricated was incorporated into the foregoing single-headed piston type swash-plate-operated refrigerant compressor and the single-headed piston type swash-plate-operated refrigerant compressor was operated for the same operational suitability test of the swash plate. No defects, such as cracks and abrasively damaged parts, were found.

EXAMPLE 5

Surface of a body made of an aluminum-base material of a swash plate was cleaned and degreased, and only the rear surface of the body was roughened by a sand blasting process. Only the rear surface of the body was coated with a coating layer of a material prepared by dispersing molybdenum disulfide particles of particle sizes in the range of 0.5 through 20 μm in a polyamidimide resin by a transfer coating process. The coating layer was baked at 200° C. The rear surface 92*b* of the swash plate was ground to form a 10 μm thick solid lubricant layer of the polyamidimide resin containing molybdenum disulfide. The swash plate in Example 5 does have any layers corresponding to the front layer 93 and the first rear layer 94 of the swash plate in Example 4, and the solid lubricant layer of the polyamidimide resin containing molybdenum disulfide corresponding to the second rear layer 95 is formed directly on the body of the aluminum-base material.

Preferably, the surface roughness Rz of the body of the swash plate is in the range of 0.4 through 15 μm, more preferably, in the range of 4 through 10 μm. The surface roughening process improves the adhesion of the solid lubricant layer to the surface of the body. The transfer coating method applies a resin containing a solid lubricant to a transfer surface of a transfer pad, and presses the transfer surface of the transfer pad against the surface of the body of the swash plate to transfer the resin containing a solid lubricant from the transfer surface to the surface of the body of the swash plate.

The swash plate thus produced was incorporated into the foregoing single-headed piston type awash plate compressor and the single-headed piston type swash plate compressor was operated for the same operational suitability test of the swash plate. No defects, such as cracks and abrasively damaged parts, were found.

EXAMPLE 6

A tin-base alloy coating was formed by plating only on the rear surfaces of the body of an aluminum-base material of a awash plate. A peripheral part 92 was ground to form a first rear layer 94 of about 150 μm in thickness. The surface of the plated first rear layer 94 was cleaned and degreased, and then the surface of the first rear layer 94 was coated with a coating layer of a material prepared by dispersing molybdenum disulfide particles of particle sizes in the range of 0.5 through 20 μm in a polyamidimide resin by a spray coating process. The coating layer was baked at 200° C. The rear surface 92*b* of the swash plate was ground to form a 10 μm thick second rear layer 95.

The swash plate thus produced was incorporated into the foregoing single-headed piston type awash plate compressor and the single-headed piston type awash plate compressor was operated for the same operational suitability test of the swash plate. No defects, such as cracks and abrasively damaged parts, were found in the front and the rear surface of the swash plate.

EXAMPLE 7

The body of an aluminum-base material of a awash plate was immersed in a sulfuric acid solution or an oxalic acid solution and was subjected to an anodizing process using the body as an anode to form an oxide film (alumite layer) over the rear surface of the body made of the aluminum-base material. The body of the swash plate was washed with water. The measured thickness of the alumite layer forming the rear layer 94 was about 15 μm. The surface of the alumite layer was cleaned and degreased, and then the surface of the first rear layer 94 was coated with a coating layer of a material prepared by dispersing molybdenum disulfide particles of particle sizes in the range of 0.5 through 20 μm in a polyamidimide resin by a spray coating process. The coating layer was baked at 200° C. The rear surface 92*b* of the swash plate was ground to form a 10 μm thick second rear layer 95.

The swash plate thus produced was incorporated into the foregoing single-headed piston type swash plate compressor and the single-headed piston type swash plate compressor was operated for the same operational suitability test of the swash plate. No defects, such as cracks and abrasively damaged parts, were found.

COMPARATIVE EXAMPLE 1

A swash plate in Comparative example 1 was produced by coating a body similar to that of the swash plate in Example 1 with only the same front layer 93 and the same first rear layer 94 as those of the copper-base alloy of Example 1 formed by the metal spraying process. The swash plate in Comparative example 1 corresponds to a swash plate obtained by omitting the second rear layer 95 of the polyamidimide resin containing molybdenum disulfide from the swash plate in Example 1.

The swash plate was incorporated into the foregoing single-headed piston type swash plate compressor and the single-headed piston type swash plate compressor was operated for the same operational suitability test of the swash plate. Cracks were found in the first rear surface 94 of the copper-base alloy formed by metal spraying.

COMPARATIVE EXAMPLE 2

A swash plate in Comparative example 2 was produced by coating a body similar to that of the swash plate in Example 4 with only the same front layer 93 and the same first rear layer 94 as those of alumite of Example 4. The swash plate in Comparative example 2 corresponds to a swash plate obtained by omitting the second rear layer 95 of the polyamidimide resin containing molybdenum disulfide from the swash plate in Example 4.

The swash plate was incorporated into the foregoing single-headed piston type swash plate compressor and the single-headed piston type swash plate compressor was operated for the same operational suitability test of the swash plate. Abrasively damaged parts were found in the first rear surface 94 of alumite.

The materials of the swash plates in Examples 1 through 7 and Comparative examples 1 and 2, and the results of the suitability tests of those swash plates are indicated in Table 1 below.

No defects were found in the rear surface of the swash plates in Examples 1 through 7 provided with the second rear surface layer, i.e., the solid lubricant layer. Cracks or abrasively damaged parts were found in the rear surface of the awash plates in Comparative examples 1 and 2 of the same material as the front surface of the same.

TABLE 1

| | Materials | | | | Test results | |
|---|---|---|---|---|---|---|
| | Front layer | Base Material (Body) | First rear layer | Second rear layer | Front surface | Rear surface |
| Example 1 | Cu-base, Metal sprayed | Fe-base | Cu-base, Metal Sprayed | MoS2 + Polyamid-imide | Defectless | Defectless |
| Example 2 | Sn-base, Metal sprayed | Fe-base | Sn-base, Metal sprayed | MoS2 + Polyamid-imide | Defectless | Defectless |
| Example 3 | Sn-base, Plated | Al-base | Sn-base, Plated | MoS2 + Polyamid-imide | Defectless | Defectless |
| Example 4 | Alumite | Al-base | Alumite | MoS2 + Polyamid-imide | Defectless | Defectless |
| Example 5 | None | Al-base | None | MoS2 + Polyamid-imide | Defectless | Defectless |
| Example 6 | None | Al-base | Sn-base, Plated | MoS2 + Polyamid-imide | Defectless | Defectless |

TABLE 1-continued

| | Materials | | | | Test results | |
|---|---|---|---|---|---|---|
| | Front layer | Base Material (Body) | First rear layer | Second rear layer | Front surface | Rear surface |
| Example 7 | None | Al-base | Alumite | MoS2 + Polyamid-imide | Defectless | Defectless |
| Compar-ative Example 1 | Cu-base, Metal sprayed | Fe-base | Cu-base, Metal sprayed | None | Defectless | Cracked |
| Compar-ative Example 2 | Alumite | Al-base | Alumite | None | Defectless | Seizing |

Note: Shoes of a bearing steel were used.

(Facility in Controlling the Thickness of Layers or the Swash Plate)

The swash plates in Examples 1 to 7 are provided with the solid lubricant layer (a layer of a polyamidimide resin containing molybdenum disulfide) only on the rear side of the peripheral part 92. The thickness of the solid lubricant layer is adjusted to 10 $\mu$m by grinding after forming a solid lubricant coating and baking the solid lubricant coating. The solid lubricant layer is ground for thickness adjustment by using the front surface 92*a*, i.e., the surface of the front layer 93 not coated with any solid lubricant layer, as a reference plane as illustrated in FIG. 5. Such thickness adjustment is possible because the front surface of the peripheral part 92 of the swash plate is not provided with any solid lubricant layer. The advantage of forming said lubricant layers only on the rear side of the peripheral part of the swash plate is apparent as contrasted with the disadvantage of forming solid lubricant layers on both sides of the peripheral part 92 of the swash plate.

Figure 6:
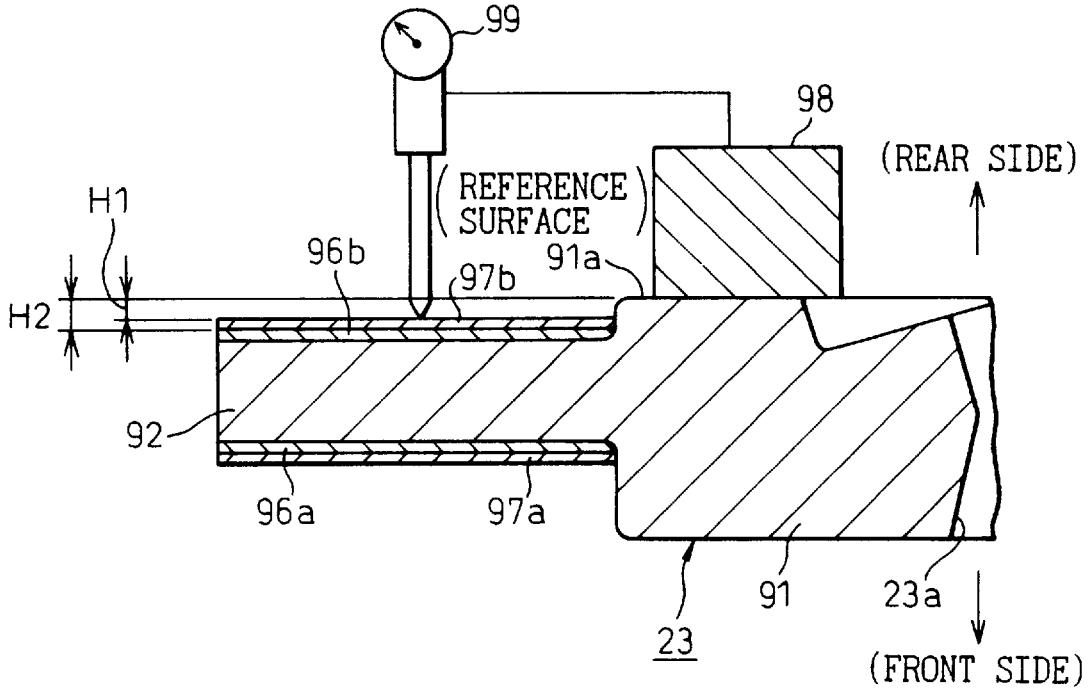
Fig. 6 (PRIOR ART)
FIG. 6 is a schematic, fragmentary sectional view of assistance in explaining a method of controlling the thickness of a formed layer according to a prior art.

FIG. 6 illustrates a swash plate formed by forming first layers 96*a* and 96*b*, such as sprayed layers of copper or tin or alumite layers, on the front and the rear side of a peripheral part 92 of the body of a swash plate, and forming second layers 97*a* and 97*b*, i.e., solid lubricant layers, on the first layers 96*a* and 96*b*, respectively. When grinding the second layers 97*a* and 97*b* formed on the front and the rear side of the peripheral part 92 to adjust the thickness of the second layers 97*a* and 97*b* (hence the thickness of the peripheral part 92 of the swash plate), a surface other than the surface of the peripheral part 92 must be used as a reference plane.

When measuring and controlling the thickness of the solid lubricant layer 97*b* on the rear side of the peripheral part 92 during a swash plate producing process, for example, the rear end surface 91*a* of the land part 91 is used as a reference plane, a block gage 98 is put on the reference plane, the tip of the plunger of a dial indicator 99 is brought into contact with the surface of the solid lubricant layer 97*b*. The height H1 of the rear end surface 91*a*, i.e., the reference plane, from the surface of the solid lubricant layer 97*b* is compared with the height H2 of the same from the surface of the first layer 96*a*. The thickness of the solid lubricant layer 97*a* on the front side of the peripheral part 92 is measured and managed similarly. A surface apart from the measured surface must be used as the reference plane when the solid lubricant layers are formed respectively on both the sides of the peripheral part 92 and, therefore, the improvement of accuracy in thickness measurement is limited and hence the severe management of the thickness of the layer and hence that of the thickness of the swash plate is difficult.

Figure 5:
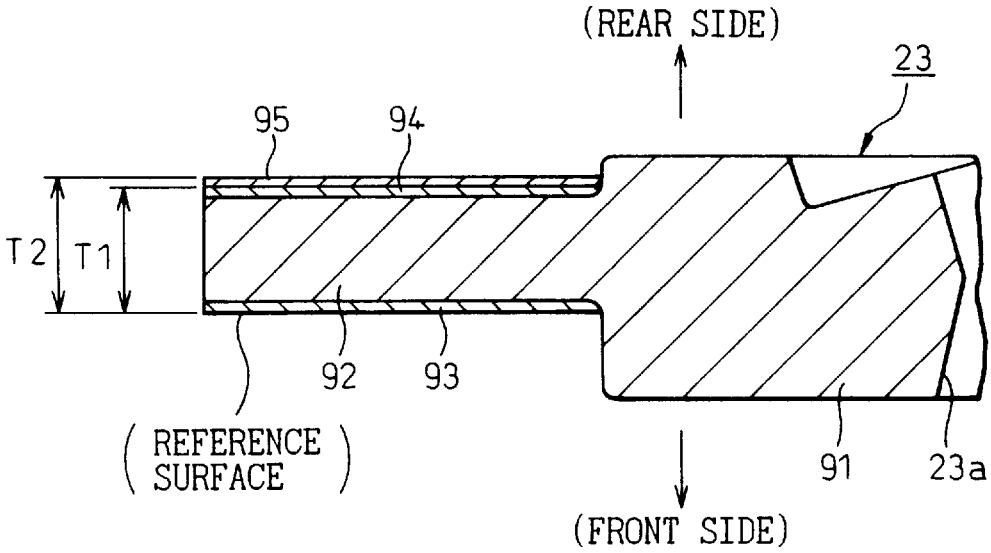
FIG. 5 is a schematic, fragmentary sectional view of assistance in explaining a method of controlling the thickness of a formed layer of the swash plate according to the present invention.

When only the solid lubricant layer, i.e., the second rear surface 95 is formed on the rear side of the peripheral part 92 as shown in FIG. 5, the surface of the front layer 92 finished by grinding and not coated with any layer can be used as the reference plane. The front layer 93 and the first rear layer 94 are formed and finished by grinding, and the distance between the surface of the front layer 93 and that of the first rear surface 94, i.e., a primary thickness T1, is measured by using the surface of front layer 93 as a reference plane. The second rear layer 95 is formed on the first rear layer 94, and the distance between the surface of the front layer 93 and that of the second rear layer 95, i.e., a secondary thickness T2, is measured. The thickness of the second rear layer 95 can be accurately determined by calculating the difference (T2−T1), i.e., the difference between the secondary thickness T2 and the primary thickness T1. Since the surface nearest to the peripheral part 92 which needs thickness management can be used as the reference plane in the construction shown in FIG. 5, accuracy in measuring the thickness of the layer can be improved, severe control of the thickness of the layer can be achieved, and the control of the thickness of the swash plate can easily be achieved.

The embodiment of the present invention and Examples 1 through 7 have the following advantageous effects.

The front and the rear surface of the peripheral part 92 of the swash plate are finished with different materials or different surface treatment processes, respectively, and the second rear layer 95 is formed after completing the surface layer on the front side, Accordingly, the thickness of the second rear layer 95 can be controlled by using the surface of the front layer as a reference plane. The thickness of the peripheral part 92 of the swash plate can accurately be measured by using the surface of the front layer after forming the second rear layer 95, so that the thickness of the swash plate can severely be managed.

Since the accuracy of thickness control of the swash plate is improved remarkably, the top clearance in the swash plate compressor with the piston 36 at its top dead center can accurately be set at a value nearly equal to zero, whereby the compression efficiency of the swash plate compressor is improved.

Antiseizing properties of the swash plate 23 to prevent seizing between the swash plate 23 and the shoes 37 when the interior of the crank chamber is led into a dry state can be improved (Examples 1 through 7).

The solid lubricant layer, i.e., the outermost layer on the rear side of the swash plate, effectively prevents the development of cracks in the sprayed layer of a copper-base alloy or the abrasive damaging of the alumite layer formed on the rear side of the swash plate (Examples 1 and 4 and Comparative examples 1 and 2).

It is known from the comparison of the swash plates in Example 1 and Comparative example 1 and those in Example 4 and Comparative example 2 that it is scarcely necessary to form a solid lubricant layer on the front side of the swash plate in the single-headed piston type swash plate compressor, because the magnitude of sliding friction between the rear surface of the swash plate and the mating shoe 37 resulting from a compression reaction force acting on the piston 36 while the piston 36 is in the compression stroke is far greater than the magnitude of sliding friction between the front surface (the surface of the front layer 93) of the swash plate and the mating shoe 37 while the piston 36 is in the suction stroke.

If the body of the swash plate 23 is made of an iron-base material having a specific gravity greater than that of an aluminum-base material (Examples 1 and 2), the swash plate 23 has a large inertia. The large inertia of the swash plate does not deteriorate the response of the swash plate for changing its inclination even when the clutchless compressor unavoidably operates at a high operating speed according to the operation of the engine 20 at a high engine speed.

The following modifications are possible in the present invention.

A variable-capacity compressor is formed to have a refrigerant compressing unit, and a solenoid clutch interposed between the compressing unit and an external drive-power source, e.g., a vehicle engine.

A swash plate having front and rear opposite surfaces onto which solid lubricant layers are applied and used for a swash-plate-operated refrigerant compressor including at least one piston to compress a refrigerant gas when a rotating motion of the swash plate is converted through a pair of shoes into a reciprocating motion of the piston, is produced by a method which comprises the steps of:

forming a temporary surface to be used as a first reference plane on one of the opposite surfaces of the swash plate;

forming a first solid lubricant layer containing a solid lubricant at least in part thereof on the other of the opposite surfaces of the swash plate;

measuring the thickness of the first solid lubricant layer or that of the swash plate by using the temporary surface formed by the first step as a reference plane;

grinding the first solid lubricant layer to adjust the thickness of the first solid lubricant layer or that of the swash plate measured in the third step to a desired thickness to form a second reference plane;

forming a second solid lubricant layer containing a solid lubricant at least in part thereof on the above-mentioned temporary surface;

measuring the thickness of the second solid lubricant layer or the swash plate by using the second reference plane formed by the fourth step; and grinding the second solid lubricant layer to adjust the thickness of the layer or the swash plate to a predetermined thickness.

Advantageous effects exhibited by the present invention are provided below.

In the single-headed piston type swash-plate-operated compressor according to the present invention stated in any one of the accompanying claims, the accuracy of the thickness of the swash plate is secured and the compression efficiency of the single-headed piston type swash plate compressor is reliably improved while the slide-friction between the swash plate and the shoes is improved and the antiseizing property and the abrasion resistance of the swash plate are improved.

The swash plate production method of the present invention facilitates the controlling of the thickness of the swash plate of the single-headed piston type swash-plate-operated compressor even if the swash plate is provided on its rear side with the solid lubricant layer for improving the slide-friction between the rear surface of the swash plate and the shoes, which enables machining accuracy in adjusting the thickness of the swash plate to a desired value.

It should be understood that many changes and modifications will occur to a person skilled in the art without departing from the scope and spirit of the present invention claimed in the accompanying claims.

What we claim:

1. A single-headed piston type swash-plate-operated refrigerant compressor comprising:

a rotatably supported drive shaft having an axis of rotation thereof;

a swash plate having a body comprising an axially front surface and an axially rear surface thereof, and mounted on said drive shaft for rotation together with said drive shaft, said swash plate body having a sprayed coating layer being applied to said front surface of said body, and a sprayed coating layer and a solid lubricant layer being applied to said rear surface of said body;

at least one single headed piston arranged on the rear side of said swash plate;

a pair of shoes arranged to keep in slide-contact with said front and rear surfaces of said swash plate to operatively engage an end part of said single headed piston with a peripheral part of said swash plate to thereby convert a rotating motion of said swash plate into a reciprocating motion of said single headed piston; and uppermost layers provided on said front and rear surfaces of said swash plate, said uppermost layers having physical surface properties different from one another in a manner such that a slide-contact performance between said rear surface of said swash plate and the corresponding one of said pair of shoes is superior to that between said front surface of said swash plate and the corresponding other of said pair of shoes and wherein said uppermost layers of said front and rear surfaces of said swash plate are made of different materials exhibiting said physical surface properties different from one another;

wherein said solid lubricant layer contains a solid lubricant at least in a part thereof, and is formed in said uppermost layer of said rear surface of said swash plate;

wherein said solid lubricant is at least one of lubricating materials including molybdenum disulfide, tungsten disulfide, graphite, boron nitride, antimony oxide, lead oxide, lead, indium, tin and fluorocarbon resins.

2. The single-headed piston type swash-plate-operated refrigerant compressor according to claim 1, wherein said uppermost layers of said front and rear surfaces of said swash plate are formed as different layers to which different surface treatment processes is applied.

3. The single-headed piston type swash-plate-operated refrigerant compressor according to claim 1, wherein said swash plate is mounted on said rotatably supported drive shaft to be able to change its angle of inclination with respect to a plane perpendicular to said axis of rotation of said swash plate.

4. The single-headed piston type swash-plate-operated refrigerant compressor according to claim 5, wherein said solid lubricant layer containing the solid lubricant and formed in said uppermost layer of said rear surface has a thickness of 0.5 through 50 micrometers ($\mu$m).

5. The single-headed piston type swash-plate-operated refrigerant compressor according to claim 4, wherein said solid lubricant layer containing the solid lubricant and formed in said uppermost layer of said rear surface has a thickness of 0.5 through 10 micrometers ($\mu$m).

6. The single-headed piston type swash-plate-operated refrigerant compressor according to claim 1, wherein said single headed piston is made of an aluminum-base material, said pair of shoes are made of an iron-base material, and said swash plate has said uppermost layer of said front surface thereof formed of a nonferrous material, said uppermost layer of said rear surface of said swash plate being formed by a solid lubricant layer containing a solid lubricant at least in part thereof.

7. The single-headed piston type swash-plate-operated refrigerant compressor according to claim 6, wherein said nonferrous material forming said uppermost layer of said front surface of said swash plate is selected from one of copper-base materials, tin-base materials and aluminum-base materials including alumite.

8. The single-headed piston type swash-plate-operated refrigerant compressor according to claim 7, wherein said uppermost layer of said front surface of said swash plate has a thickness of 2 through 500 micrometers ($\mu$m).

9. The single-headed piston type swash-plate-operated refrigerant compressor according to claim 8, wherein when said uppermost layer of said front surface of said swash plate is made of aluminum-base materials including alumite, said front surface has a thickness of 2 through 20 micrometers ($\mu$m).

10. The single-headed piston type swash-plate-operated refrigerant compressor according to claim 6, wherein said swash plate is provided with a base material thereof being an iron-base material, and wherein an intermediate layer made of one of a copper-base material and a tin-base material is formed between a part of said iron-base material of said swash plate, and said solid lubricant layer forming said uppermost layer of said rear surface of said swash plate.

11. The single-headed piston type swash-plate-operated refrigerant compressor according to claim 10, wherein said intermediate layer made of one of the copper-base material and the tin-base material is formed as a sprayed coating made of one of the copper-base material and the tin-base material.

12. The single-headed piston type swash-plate-operated refrigerant compressor according to claim 6, wherein said swash plate is provided with a base material thereof being an aluminum-base material, and wherein an intermediate layer of one of a tin-base material and alumite is formed between a part of said aluminum-base material of said swash plate and said solid lubricant layer of said rear surface of said swash plate.

13. The single-headed piston type swash-plate-operated refrigerant compressor according to claim 6, wherein said swash plate has a base material thereof being an aluminum-base material, and wherein said rear surface of said swash plate is formed by said solid lubricant layer directly applied onto said aluminum-base material.

14. The single-headed piston type swash-plate-operated refrigerant compressor according to claim 13, wherein said solid lubricant layer is applied to said aluminum-base material which is finished by a surface roughening process.

15. The single-headed piston type swash-plate-operated refrigerant compressor according to claim 1, wherein said sprayed coating layer comprises one of copper, tin, or alumite.

16. The single-headed piston type swash-plate-operated refrigerant compressor according to claim 1, wherein said sprayed coating layer is said uppermost layer in said front surface, and said solid lubricant layer is said uppermost layer in said rear surface, and wherein said sprayed coating layer functions as a protective layer so that said rear surface of the swash plate is not directly exposed even if said solid lubricant layer is damaged.

17. A method of producing a swash plate for a single-headed piston type swash-plate-operated refrigerant compressor in which a rotating motion of the swash plate mounted on a drive shaft rotatable about an axis of rotation extending from a front to a rear side of said refrigerant compressor is converted through a pair of shoes into a reciprocating motion of a piston, comprising the steps of:

forming a front surface having a sprayed coating layer in said swash plate so that said front surface is in direct contact with a first one of said pair of shoes and serves as a reference plane;

forming a sprayed coating layer and a solid lubricant layer in a rear surface of said swash plate opposite to said front surface so that said solid lubricant layer is in direct contact with a second one of said pair of shoes and containing a solid lubricant at least in part thereof, wherein said solid lubricant is at least one of lubricating materials including molybdenum disulfide, tungsten disulfide, graphite, boron nitride, antimony oxide, lead oxide, lead, indium, tin and fluorocarbon resins;

wherein said front and rear surfaces are provided with respective uppermost layers thereof, said uppermost layers having physical surface properties different from one another in a manner such that a slide-contact performance between said rear surface of said swash plate and the corresponding one of said pair of shoes is superior to that between said front surface of said swash plate and the corresponding other of said pair of shoes, wherein said uppermost layers of said front and rear surfaces of said swash plate are made of different materials exhibiting said physical surface properties different from one another, and wherein said solid lubricant layer, containing said solid lubricant at least in a part thereof, is formed in said uppermost layer of said rear surface of said swash plate;

measuring at least one of the thickness of said solid lubricant layer formed on said rear surface and the thickness of said swash plate by using said front surface formed by the first step as said reference plane; and applying a grinding operation to said solid lubricant layer to adjust the thickness of said solid lubricant layer and that of said swash plate measured in the third step to respective desired thicknesses.

* * * * *